350-333 SR
12/24/85 XR 4,560,982

United States Patent [19]

Sonehara et al.

[11] Patent Number: 4,560,982

[45] Date of Patent: Dec. 24, 1985

[54] DRIVING CIRCUIT FOR LIQUID CRYSTAL ELECTRO-OPTICAL DEVICE

[75] Inventors: Tomio Sonehara; Masami Murata; Tadashi Ota, all of Suwa, Japan

[73] Assignee: Kabushiki Kaisha Suwa Seikosha, Tokyo, Japan

[21] Appl. No.: 403,753

[22] Filed: Jul. 30, 1982

[30] Foreign Application Priority Data

Jul. 31, 1981 [JP] Japan ..... 56-121112

[51] Int. Cl.[4] ..... G09G 3/36

[52] U.S. Cl. ..... 340/784; 340/805; 350/333

[58] Field of Search ..... 340/752, 783, 784, 802, 340/805; 350/332, 333

[56] References Cited

U.S. PATENT DOCUMENTS

| | | | |
|---|---|---|---|
| 3,955,187 | 5/1976 | Bigelow | 350/333 |
| 3,976,362 | 8/1976 | Kawakami | 350/333 |
| 4,378,557 | 3/1983 | Murata | 340/805 |
| 4,385,294 | 5/1983 | Miles | 340/805 |
| 4,427,978 | 1/1984 | Williams | 340/784 |
| 4,462,027 | 7/1984 | Lloyd | 340/805 |

*Primary Examiner*—Gerald L. Brigance
*Attorney, Agent, or Firm*—Blum, Kaplan, Friedman, Silberman & Beran

[57] ABSTRACT

A liquid crystal display device having non-linear characteristics provides uniform quality in a matrix display. In driving rows and columns of picture elements the duty ratio is substantially increased by shortening the time in which the picture element is selected and charged for lighting. Charging time is less than the half frame period divided by the number of columns to be driven in the half frame, and more rows of elements can be driven in the half frame period. The portion of time actually used for charging is designated as a fine scanning period. By modulating the voltage levels across the liquid crystal layer during fine scanning periods when the crystal element is not selected, effective voltage across the picture elements is maintained with little variation regardless of the number of picture elements driven on the same signal line. A gray scale display can be provided.

20 Claims, 25 Drawing Figures

FIG. 1
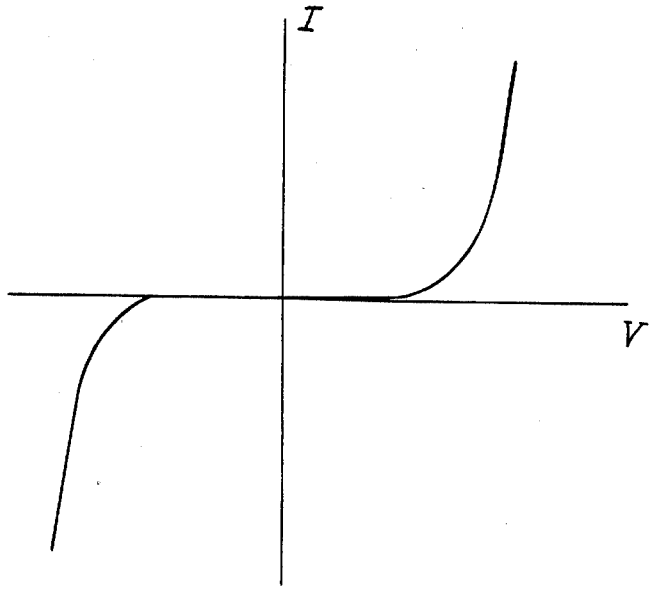
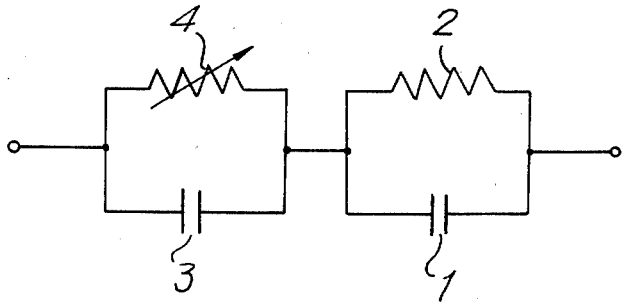
FIG. 2

FIG. 4a
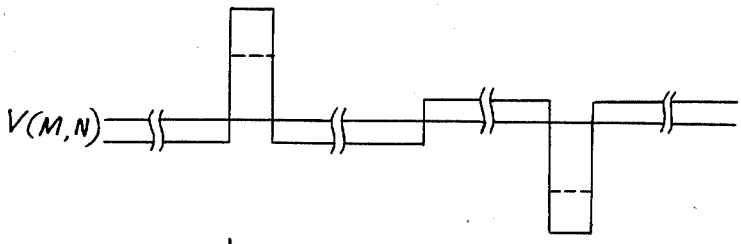
FIG. 4b
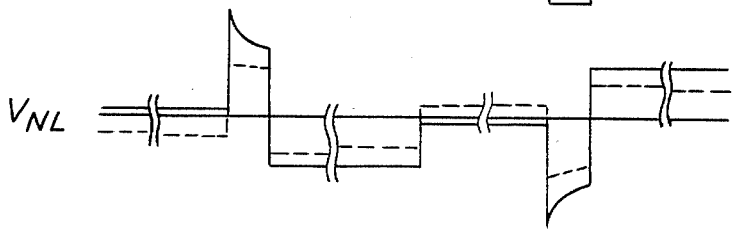
FIG. 4c
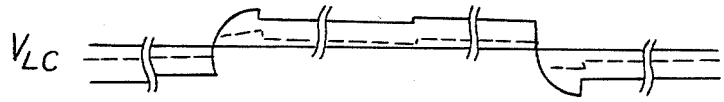
FIG. 5a
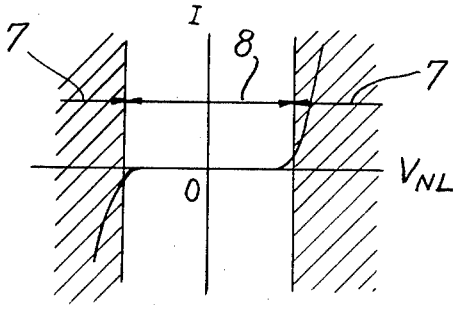
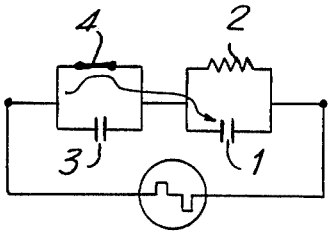
FIG. 5b
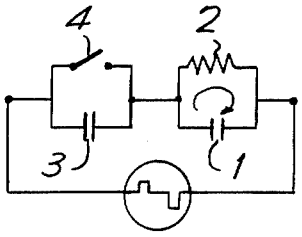
FIG. 5c FIG. 11
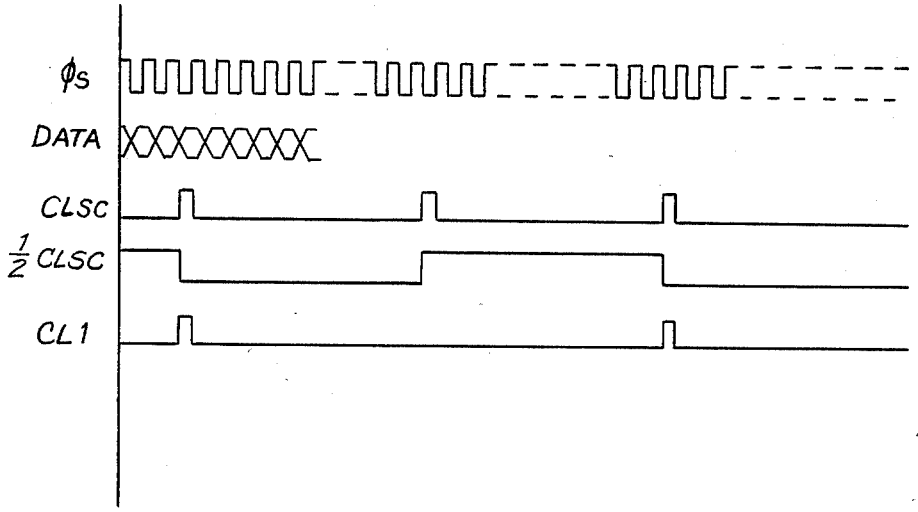
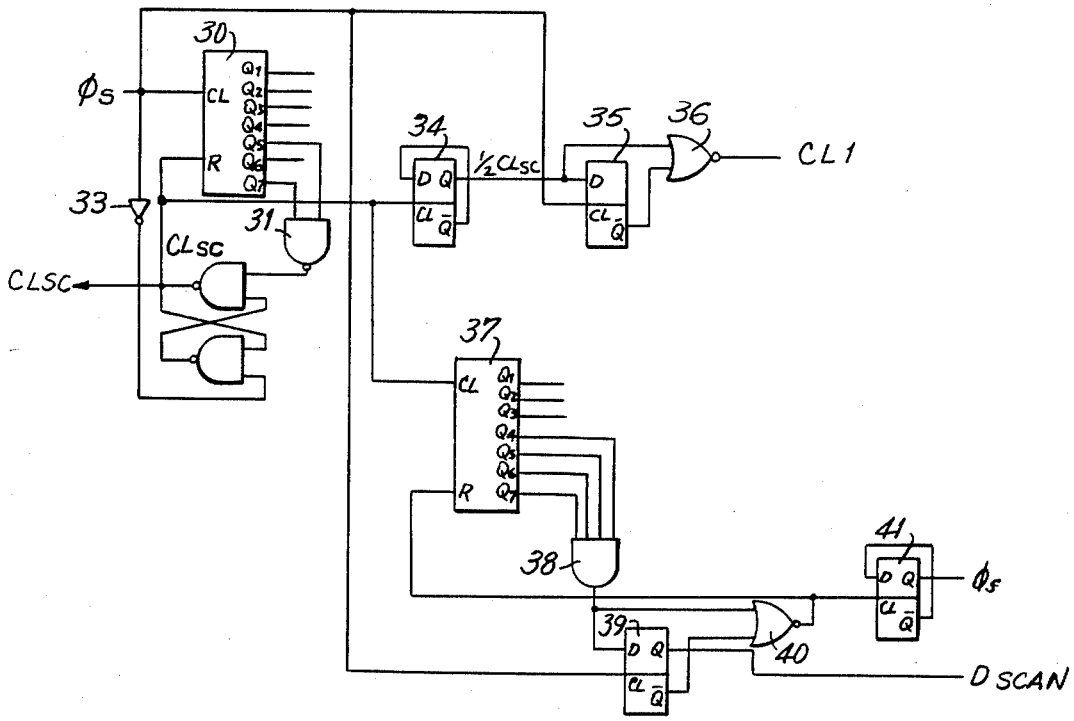
FIG. 13

DRIVING CIRCUIT FOR LIQUID CRYSTAL ELECTRO-OPTICAL DEVICE

BACKGROUND OF THE INVENTION

This invention relates generally to a liquid crystal display device and more particularly to a liquid crystal display using a non-linear device and driven by an AC amplitude selective multiplexing signals in a two-frame method. More particularly, this invention relates to a multiplexing drive method for controlling variations in the effective voltage applied to the liquid crystal picture elements. Use of non-linear devices in conjunction with liquid crystal display elements has improved the driving duty for the elements. For example, varistors and MIM are known non-linear devices. Methods of driving a liquid crystal display device using such non-linear components have been the same as in a conventional driving method of the prior art. Namely, a generalized AC amplitude selective multiplexing signal is used wherein the ON and OFF states are alternatingly switched at the half point of a frame, that is, the so-called two-frame method. However, the conventional method has disadvantages in that the effective voltage applied to one picture element in the liquid crystal layer is likely to be influenced by the signals to other picture elements on the same signal line. As a result, a non-uniformity in display for different kinds of display patterns is due to variations in the effective voltage. Also, the conventional driving method is unsuited for a gray scale display and it is difficult to match the characteristics of the non-linear device.

What is needed is a liquid crystal display device of the matrix type having rows and columns of picture elements which provides uniform display quality regardless of the number of elements in a row which are lit and non-lit.

SUMMARY OF THE INVENTION

Generally speaking, in accordance with the invention, a liquid crystal display device having non-linear characteristics and especially suitable for providing uniform quality in a matrix display is provided. In driving the rows and columns of picture elemens in a matrix, the duty ratio is substantially increased by shortening the time in which the picture element is selected to be charged for lighting. The charging time is made less than the half frame period divided by the number of columns to be driven in the half frame. Thus, within the available time in the half frame for charging each picture element, only a portion of that time is used for charging, this portion being designated as a fine scanning period. Because less than the available full scanning period is used to charge the liquid crystal element, more rows of elements can be driven in the half frame period. Also, by modulating the voltage levels across the liquid crystal element during the fine scanning periods wherein the crystal element is not selected, the effective voltage across the picture elements is maintained with little variation regardless of the numbers of picture elements which are driven on the same signal line. A gray scale display can be provided with this fine scanning method by varying the voltage conditions during the fine scanning period wherein the picture element is selected.

Accordingly, it is an object of this invention to provide an improved liquid crystal display device which has improved driving duty as a result of using a non-linear device in conjunctio with the picture element.

Another object of this invention is to provide an improved liquid crystal display device driven by an AC amplitude selective multiplexing signal, wherein effective voltage applied to the picture elements is not influenced substantially by the number of picture elements driven on the same signal line.

A further object of this invention is to provide an improved liquid crystal display device wherein the picture element, when selected, is charged in substantially less time than the time available for charging.

Still another object of this invention is to provide an improved liquid crystal display device wherein a pause period is provided prior to completion of the half frame.

Yet another object of this invention is to provide an improved liquid crystal display device which controls effective voltage across the picture elements and allows for a gray scale display.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is the voltage-current characteristic of a typical non-linear device;

FIG. 2 is the equivalent circuit of a non-linear liquid crystal display device;

FIGS. 4*a–c* are driving waveforms of a non-linear liquid crystal display device;

FIGS. 5*a–c* is a graph of applied voltage versus current for a non-linear device and equivalent circuits of said non-linear liquid crystal display device showing current flow;

FIG. 11 and FIGS. 12*a,b* are waveforms associated with the circuits of FIGS. 10 and 13; and FIG. 13 is a control circuit producing signals for the driving circuit of FIG. 10.

DESCRIPTION OF THE PREFERRED EMBODIMENTS

This invention relates to liquid crystal electro-optical devices. The number of applications of liquid crystal electro-optical devices has increased remarkably in recent years to include such devices as a light valve, a display for an electronic calculator, and in the displays of electronic timepieces. Use of liquid crystals in a display device for a small-sized personal computer, or the like is now under consideration. However, a dynamic system in a conventional liquid crystal display has a limitation of a 1/30 drive duty. In view of this, it is difficult for the conventional display to present large quantities of information, greater than the above drive duty. Therefore, several systems have been developed to overcome this drive duty limitation of the dynamic system as follows:

1. Non-linear device addressing including varistor, metal-insulator-metal(MIM), diode and discharge tube addressing.
2. Active switching addressing including thin film transistor, MOS transistor and triac addressing.
3. Light-heat writing system including laser-heat and light-conductor writing.
4. Two frequency addressing system.

Also, there are other systems. This is to say, there is an eagerness to develop liquid crystal display devices for displaying large quantities of information.

This invention relates to a construction for driving liquid crystal electro-optical devices using switching elements having non-linear characteristics, that is, Group 1 above and using active switching elements, that is, Group 2 above. More particularly, this invention relates to a multiplexing driving method for controlling the variation of effective voltage applied to picture elements of a liquid crystal electro-optical device.

FIG. 1 shows the voltage current charactertistics of MIM devices having typical non-linear characteristics. Additionally, varistors and diodes connected in series in the reverse directions, utilizing the avalanche break down voltage in Pn junctions; have non-linear charactistics similar to FIG. 1. Any element can be adapted as a switching element if only it has non-linear characteristics wherein resistance is high when low voltage is applied and resistance is low when high voltage is applied as shown in FIG. 1. It is known that liquid crystal electro-optical devices using such non-linear devices can be driven in multiplex mode with many more lines than the general multiplexing drive as explained more fully hereinafter.

FIG. 2 is a drawing of an equivalent circuit of a picture element electrode, the equivalent circuit comprising a capacitance CLC 1 and resistance RLC 2 of the liquid crystal, and capacitance CNL 3 and resistance RNL 4 of the non-linear device. RNL 4 is at a low value when the voltage applied to the non-linear device is high, and the resistance RNL 4 is high when the voltage applied to the non-linear device is low.

Figure 3B:
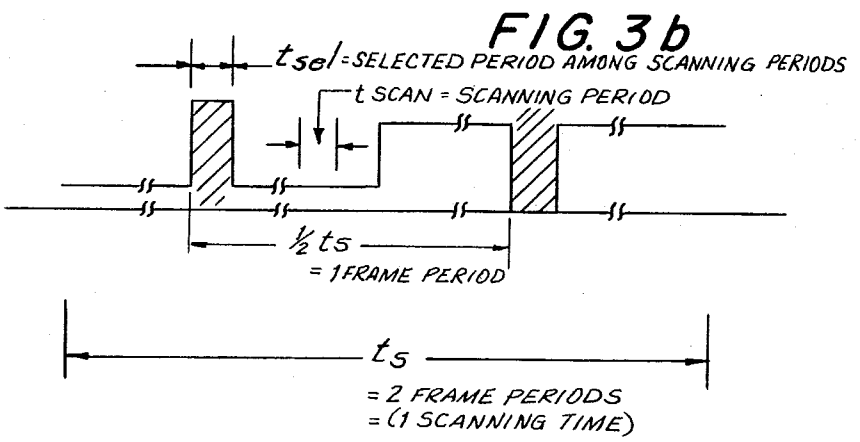
FIGS. 3*a–d* are display picture elements in a matrix of rows and columns and waveforms for driving said matrix panel by a conventional generalized AC amplitude selective multiplexing method.
Figure 3C:
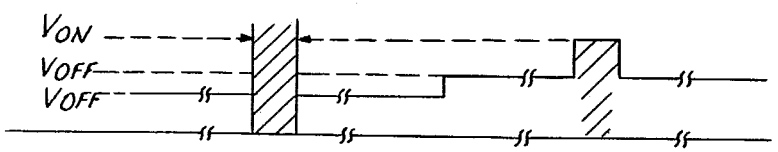
Figure 3D:
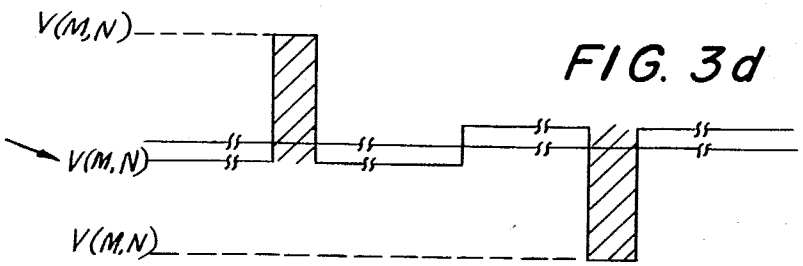
Figure 3A:
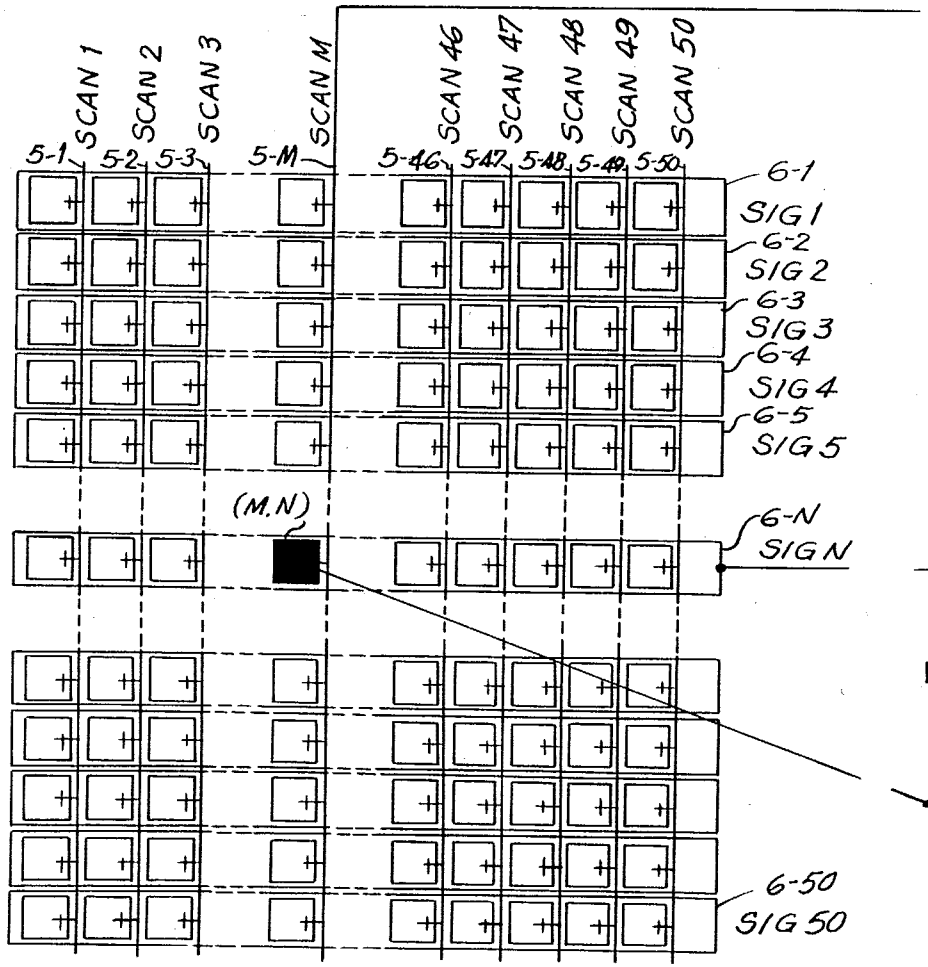

FIGS. 3*a–c* show waveforms of a 1/50 duty cycle and 1/5 bias method when the signal for driving the liquid crystal elements is applied to the terminal of the equivalent circuit (FIG. 2). FIG. 3*a* indicates picture elements in a matrix display consisting of scanning electrodes 5-1 to 5-50 and signal electrodes 6-1 to 6-50. Scanning signals SCAN 1 to SCAN 50 are respectively applied to each scanning electrode 5-1 to 5-50. Display signals SIG 1 to SIG 50 are respectively applied to each signal electrode 6-1 to 6-50. In this embodiment, a display picture element (M,N) corresponding to the scanning electrode 5-M and signal electrode 6-N, for example, is in the lit state and the other display picture elements are in a non-lit state.

FIG. 3*b* indicates waveforms of the scanning signal in this example, and FIG. 3*c* indicates the waveform of the display signals. In these Figures, ts is a scanning period during which signals are applied to all display picture elements. Tsel in FIG. 3*b* is a selected period of scanning signal SCAN M by which the scanning electrode 5-M is selected. In view of FIG. 3*c*, the signal electrode 6-N is VON in this selected period tsel, and the signal electrode 6-N is VOFF in other scanning signal periods not including the illustrated SCAN N. Accordingly, the voltage applied to the display picture element (M,N) is represented as follows:

$$V(M,N) = \text{SCAN } M - \text{SIG } N$$

This mathematical representation is shown graphically in FIG. 3*d*.

FIG. 4*a* indicates the waveform V(M,N) of the applied voltage (FIG. 3*d*) by a solid line at the time when the display picture element (M,N) is VON. FIG. 4*b* indicates the voltage waveform across the non-linear device using a solid line. FIG. 4*c* indicates the voltage waveform VLC applied across the liquid crystal layer of the picture element with a solid line. As shown in FIGS. 4*a–c*, the following relationship is obtained $$V(M,N) = VNL + VLC$$

That is, the instantaneous voltages across the non-linear device and the liquid crystal add up to equal the input driving signal V(M,N).

In FIGS. 4*a–c* the broken lines indicate that the display picture element (M,N) is VOFF.

FIGS. 5*a–c* illustrate the concepts of activating the non-linear device and the liquid crystal layer. FIG. 5*a* illustrates the applied voltage VNL versus current I characteristics of the non-linear device. In view of FIG. 5*a*, the resistance of the non-linear device becomes low in the region 7 and is high in the region 8. FIG. 5*b* illustrates the current flow i when the resistance RNL 4 of the non-linear device is low, that is, nearly zero in value.

FIG. 5*c* illustrates current flow i when the resistance RNL 4 of the non-linear device is high, that is, almost an open circuit with infinite resistance. As shown in FIG. 5*b*, when the non-linear device is a region of low resistance, the driving voltage is almost entirely applied to the liquid crystal layer so that the liquid crystal layer is charged. The time constant of the equivalent circuit in FIG. 2 is represented as follows:

$$\tau = (CLC + CNL) \times \frac{RLC \times RNL}{RCL + RNL} \quad (1)$$

When the resistance RNL of the non-linear device is nearly zero (FIG. 5*b*), the current i transiently flows to charge CLC 1 and with the capacitance 3 is effectively shorted out, the applied voltage is entirely across the liquid crystal layer.

Subsequently, the display picture element V(M,N) is in the non-selected period and the non-linear characteristics of the non-linear element turns from the region of high voltage 7 to the region of low voltage 8. Accordingly, the resistance RNL of the non-linear device is much much larger than the resistance RLC of the liquid crystal. The transient current i which flows in discharging the capacitor 1 of the liquid crystal, flows through the resistance RLC 2 as shown in FIG. 5*b*. At this time the time constant is approximately $$\tau=(CLC+CNL)RLC \quad (2)$$

Basically, the capacitance 1 of the liquid crystal RLC is rapidly charged and slowly discharged. In general, the liquid crystal of the field effect type utilized for the liquid crystal display panel has a large resistance RLC. Accordingly, it is possible to make $\tau$ as long as the scanning time.

In FIGS. 4*a–c*, when the display picture element is at the non-lighting level as indicated by the broken line, the applied voltage VNL is not in the lighting region even at the peak value. This does not charge the liquid crystal layer. Therefore, VLC remains at a low level. Accordingly, the comparison of the effective value of the lighting level voltage against the non-lighting level voltage in the liquid crystal layer is greater than that in a conventional driving method by a generalized AC amplitude selective multiplexing system without the use of the non-linear devices. Therefore, it is possible to drive more lines in multiplex when using a driving method using a non-linear device in conjunction with the liquid crystal. Thus, an increase in the display capacity is achieved for liquid crystal display devices.

Nevertheless, the above described multiplexing driving method is unfavorable in that the effective voltage applied to the liquid crystal layer varies due to the display signal in the non-selected period. This disadvantage is explained with reference to FIGS. 6*a–c*.

Figure 6A:
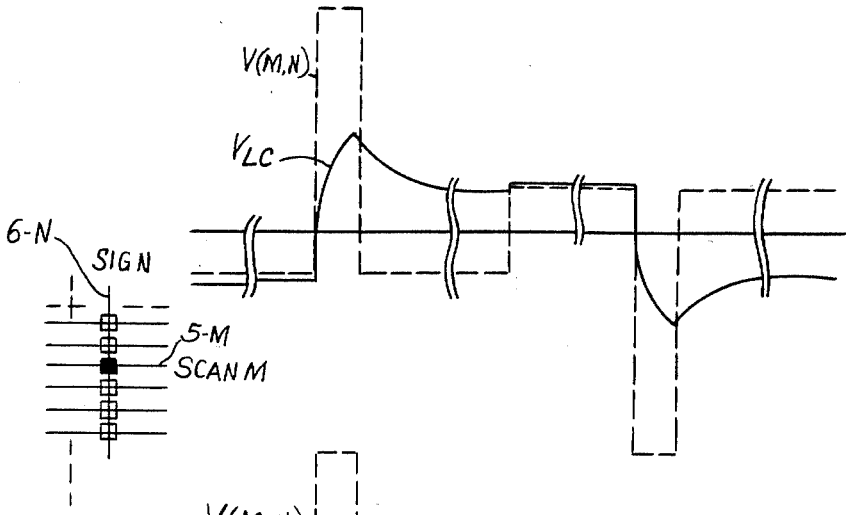
FIGS. 6*a–c* are voltage waveforms applied to picture elements of a non-linear liquid crystal display device and to the liquid crystal layer.
Figure 6B:
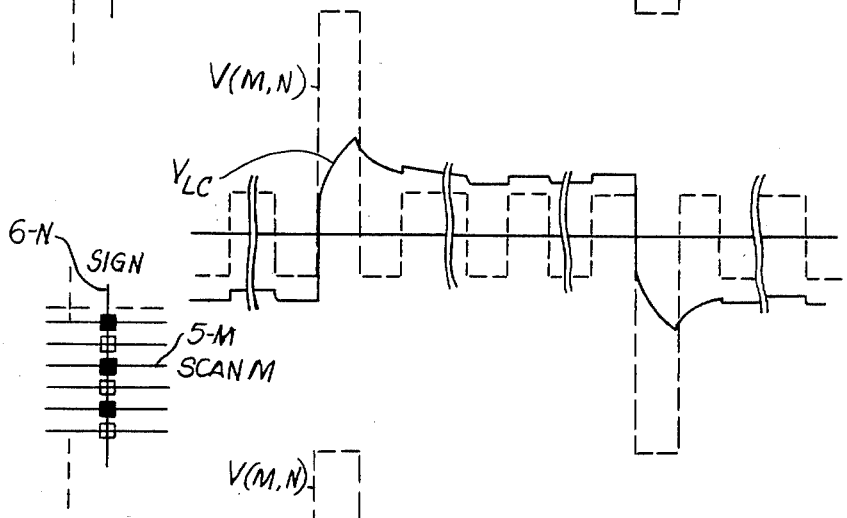
Figure 6C:
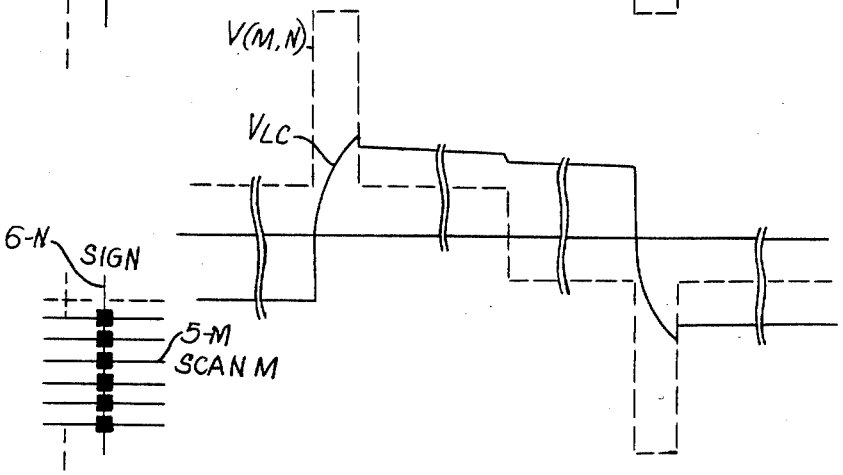

FIG. 6*a* is the waveform of the voltage VLC across the liquid crystal at the time when only one display signal electrode at column 5-M is lit in the signal electrode row 6-N. FIG. 6*b* is the waveform of the voltage VLC when every second line M of display signal electrodes is lit in the signal electrode row 6-N. FIG. 6*c* is the waveform VLC when all display signal electrodes are lit in a signal electrode row 6-N. The voltage V(M,N) applied to the display picture element is shown with broken lines and the voltage VLC applied to the liquid crystal layer is shown in the solid lines. As described above, the characteristics of VLC are determined by the presence of a non-linear element associated with each picture element.

With respect to FIGS. 6*a–c*, the voltage VLC across the liquid crystal is substantially varied in accordance with the state, that is, lit or non-lit of the other elements facing the same signal electrode (SIG). The voltage VLC is also substantially varied when the display picture element (M,N) is a non-lit condition. Therefore, a conventional binary digit is displayed by making the minimum EON min of the effective voltage of the lighting waveform greater than the saturation voltage Vsat of the liquid crystal, and making the maximum EOFF max of the effective voltage of the non-lighting waveform less than the threshold voltage Vth of the liquid crystal. Because of the variations in the effective voltage VLC as the number of picture elements in a given electrode row N are lit, a non-linear liquid crystal display device has been considered suitable for application only in a binary digit display, that is, ON or OFF, but unsuited for a gray scale display. Further, where EON min and EOFF max are marginally fixed, the quality characteristics of the non-linear device must be so precise that it is difficult to manufacture such a device. Further, there is a problem in the display itself in that the variation of the effective voltage VLC is directly evident as a variation of contrast in the situation of an indistinct saturation voltage such as the Guest-Host Effect.

An object of this invention is to eliminate the disadvantage described above by controlling the variations of the effective voltage VLC of the display signal. In this invention a non-linear liquid crystal display device is adapted for gray scale display, prevents variation of contrast, and increases the margin. Variation of the effective voltage is decreased by approaching median levels of EON min and EOFF max.

A further object of this invention is to make the discharge of the liquid crystal element uniform when a switching element is at the OFF state by subdividing one scanning period into a plurality of portions at the selected and non-selected levels. Therefore, not only a non-linear device, but also an active switching device, such as TFT and MOS transistor, can be used in the method for driving a liquid crystal display device in accordance with the invention.

Figure 7:
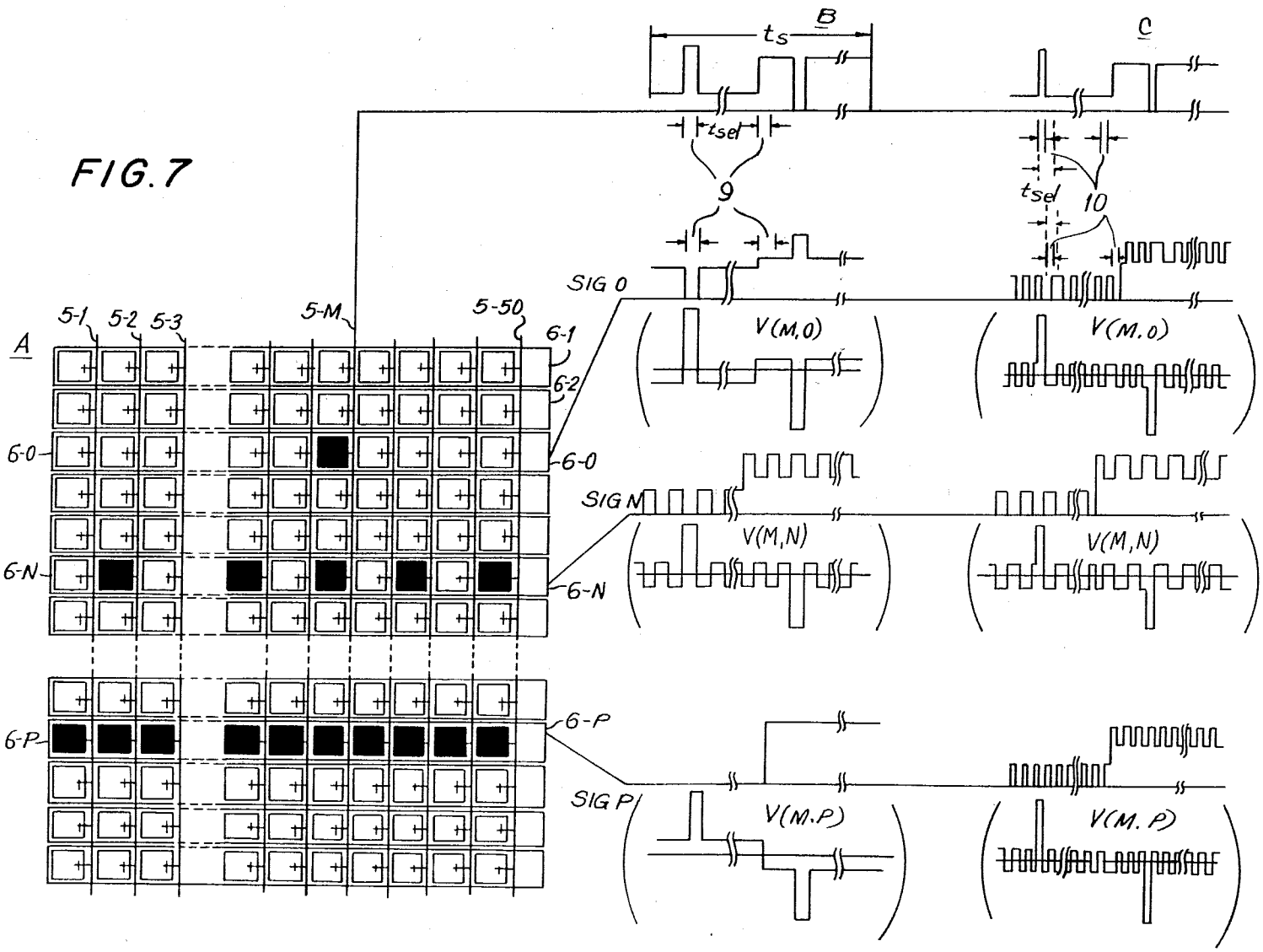
FIG. 7 is similar to FIG. 3 and provides a comparison of driving waveforms by the conventional method of FIG. 3 and in accordance with this invention.

An embodiment of this invention is now explained in greater detail. FIG. 7 allows a comparison of the waveforms in accordance with the conventional driving method (waveforms B) and the waveforms in accordance with this invention (waveforms C). The signals drive a display panel consisting of display picture elements (A), arranged in a matrix. In the matrix, only one picture element at column 5-M in the picture element row 6-O is lit. Every second picture element column is lit in picture element row 6-N, and all picture element columns are lit in picture element row 6-P.

The driving method in accordance with this invention as shown in FIG. 7 is determined by a 1/50 duty cycle and 1/5 bias method similar to the conventional drive. According to the conventional generalized AC amplitude selective multiplexing method as shown in FIG. 7 at B, the scanning time ts is divided in half for driving with alternating current. The half period is further divided to accommodate 50 columns, and as a result the scanning time ts is divided in total into 100 parts. This one time unit, that is, 1/100 of the scanning time ts is called one scanning period 9. The scanning signal SCAN is at the selected level during one selected period Tsel once in every half of the scanning time ts, and is at a non-selected level during the remainder of the scanning periods 9.

On the other hand, in accordance with the driving method of this invention as shown in FIG. 7 at C, one selected period Tsel, wherein the scanning signal is at the selected level during each half of the scanning time, is further divided into a plurality of periods. This shorter time is referred to as the fine scanning period 10. The scanning signal is the selected level in a part of the fine scanning period, and at the non-selected level in another part of the fine scanning period. One scanning period 9 is divided into fine scanning periods 10 in various ratios, that is, in unequal intervals or in equal intervals. The embodiment hereinafter described is for a scanning period which is equally divided into halves, that is, two fine scanning periods.

In the driving method in accordance with the invention as shown in FIG. 7 at C, SCAN M is the Mth scanning signal which is generally the same as the scanning signal of 1/100 duty cycle at B. The display signals which are applied to the display element rows 6-O, 6-N and 6-P are indicated as SIG O, SIG N and SIG P. One selected period Tsel of the display signal is divided in half as is the scanning signal. Only a portion of the fine scanning period 10, in this embodiment, the first half, is taken at the same level as that of the generalized AC amplitude selective multiplexing method and the other fine scanning period is taken at the reverse level. That is, a signal is produced so that the non-selected level is taken against the selected level and the selected level is taken against the non-selected level. As a result, waveforms of the display signals which are applied to each display picture element 6-O, 6-N, 6-P are respectively SIG O, SIG N and SIG P. In accordance with the driving signals at C of the invention, the waveforms of the picture element applying voltage varies in the same manner as the 1/100 duty cycle centering to a standard level. However, the averages between the selected period and the non-selected period in the three rows are almost equal when compared in a half scanning period.

Figure 8A:
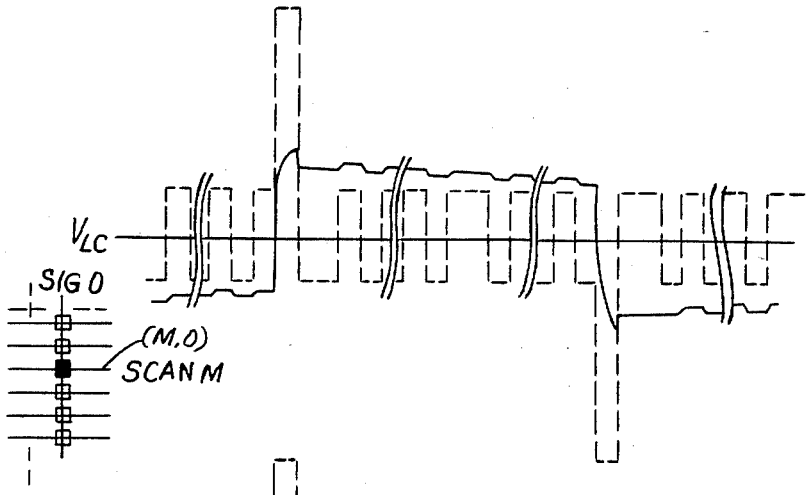
FIG. 8 is similar to FIG. 6 illustrating waveforms of the voltage applied to the liquid crystal layer in accordance with the invention.
Figure 8B:
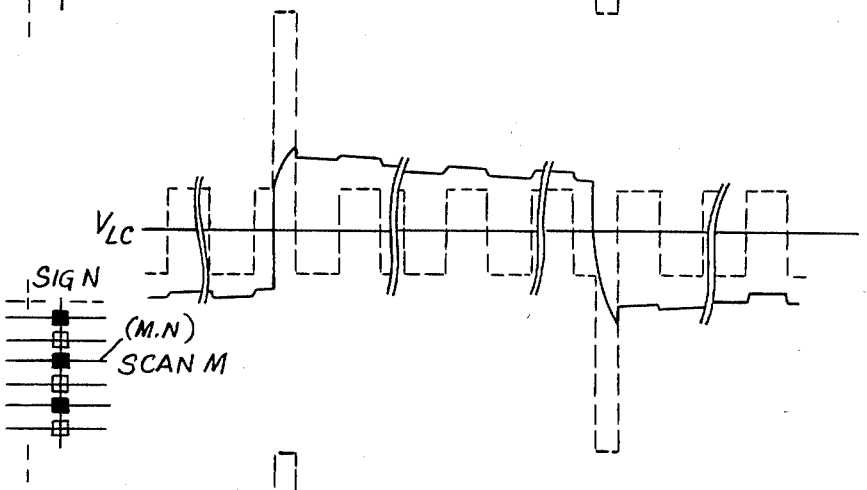
Figure 8C:
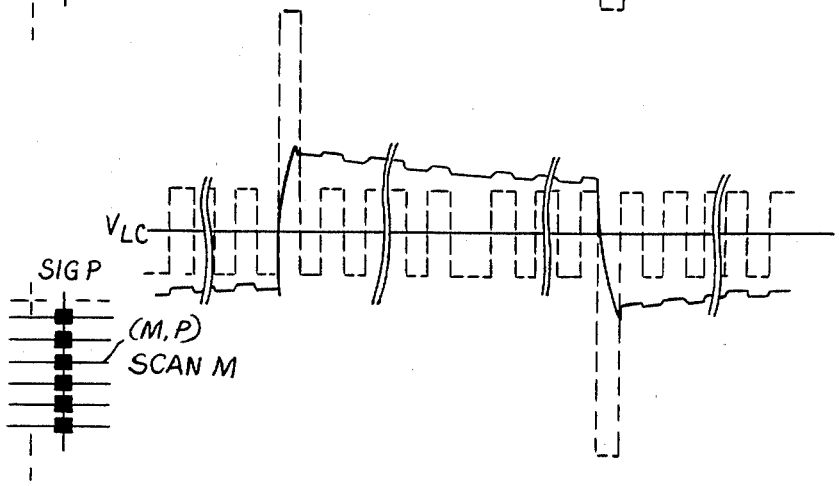

FIGS. 8*a–c* respectively indicate with solid lines the voltage VLC applied to the liquid crystal layer relative to the voltage, shown with broken lines, applied respectively to the display picture elements (M,O), (M,N), and (M,P). In comparison with the conventional driving method as shown in FIGS. 6*a–c* the waveforms VLC in accordance with the invention (FIGS. 8*a–c*) have substantially equal discharge waveforms, excepting fine variations due to the display panel. Thus, the driving method in accordance with the invention effectively decreases the variations in the effective voltage VLC across the liquid crystal layer caused by the display signals. In other words, as stated above, the effective voltage VLC applied to the picture elements is determined without being affected by ON-OFF conditions on the same signal electrode. Therefore, a gray scale display, which is considered impossible in the conventional non-linear element liquid crystal display device, is made possible by modulating the peak level in the selected period, and setting the time for the selected level and the peak level.

Further, the voltage margin in the conventional non-linear element liquid crystal display device is from the maximum effective voltage of the OFF waveform to the minimum effective voltage of the ON waveform. Such a voltage margin is expanded in the driving method in accordance with the invention for the voltage margin is provided between particular levels of OFF waveforms and ON waveforms. Further, a liquid crystal display in accordance with the invention performs multiplexed drivings of two N columns, in fact, in the time of multiplexed drivings of N columns. A increased number of columns is not utilized in the conventional multiplex panel because it induces a decrease in margin. However, the non-linear element liquid crystal display device is effective regardless of an increase in the number of driving columns, provided that there is sufficient time for charging the equivalent capacitance CLC of the liquid crystal layer to a sufficient level during the fine scanning period where the peak voltage of the ON waveform is applied thereto. In fact, it is possible to make the charging time very short and 1/1000 duty may be possible due to the characteristic of the non-linear element.

In the embodiment described above, one scanning period is divided into two equal parts. However, the scanning period is not necessarily divided into two equal parts. This period may be divided into a plurality of fine scanning periods if only there is a peak voltage in one scanning period. This period may similarly be divided into unequal parts, namely, one scanning period may be divided into any number of fine scanning periods which would only have to have sufficient time for charging the equivalent capacitance CLC to a sufficient level. Actually, however, division of one scanning period into two equivalent parts is the best when considering simplicity of the driving circuitry and the decrease in variation of the effective voltage.

Additionally, one scanning period does not have to be produced by dividing one scanning time ts into 2N equivalent parts, provided that the period wherein the scanning signal is at the selected level is sufficiently long to charge the equivalent capacitance CLC to a sufficient level in the selected period of the ON waveform. In other words, a period x ts which is shorter than one scanning time ts, that is, $0<x\leqq 1$, may be divided into 2N equivalent parts, each part to serve as one scanning period.

Figure 9:
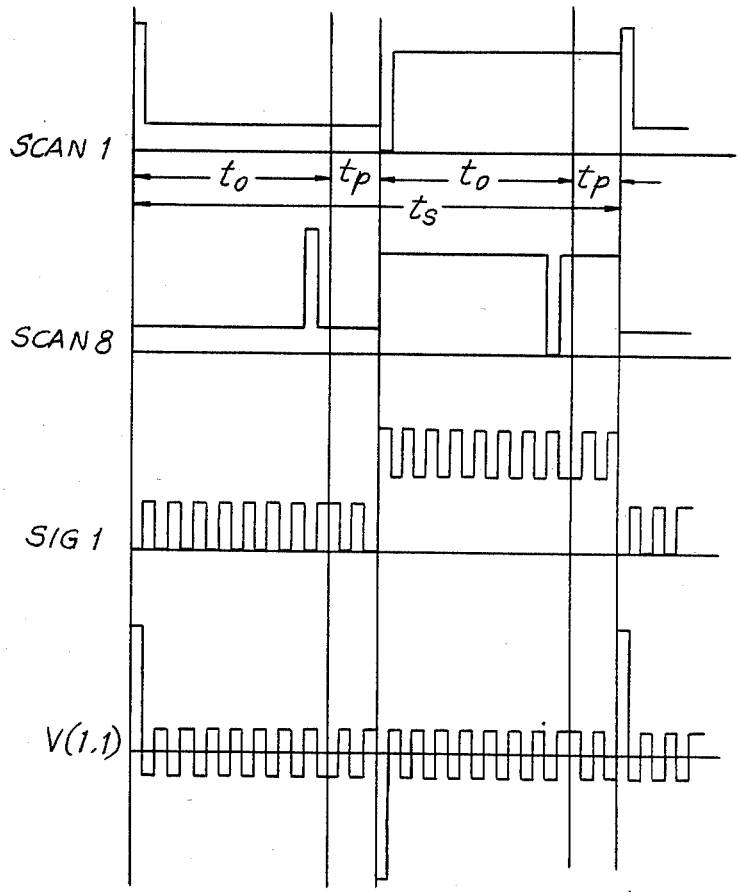
FIG. 9 shows driving waveforms for a liquid crystal matrix device in accordance with the invention, providing a pause period.
Figure 9:
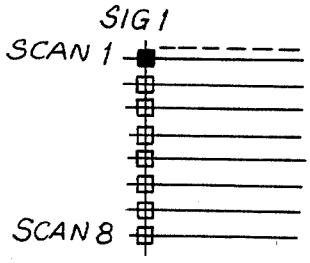

FIG. 9 shows scanning signals SCAN 1 and SCAN 8 and a display signal SIG 1 when $N=8$ and $x=0.8$, using 1/5 bias method. In FIG. 9, the display period tD is the accummulation of eight scanning periods. A pause period tP is a time in which no scanning periods applies. All signal electrodes are at the non-selected level during the pause period tP. The display signal in the pause period tP may be indicated not only by the non-selected waveform as shown in this embodiment in accordance with the invention but also by selected waveforms. Further, the selected level and the non-selected level in this period in accordance with the invention are not limited to those used in the conventional driving method.

Figure 10:
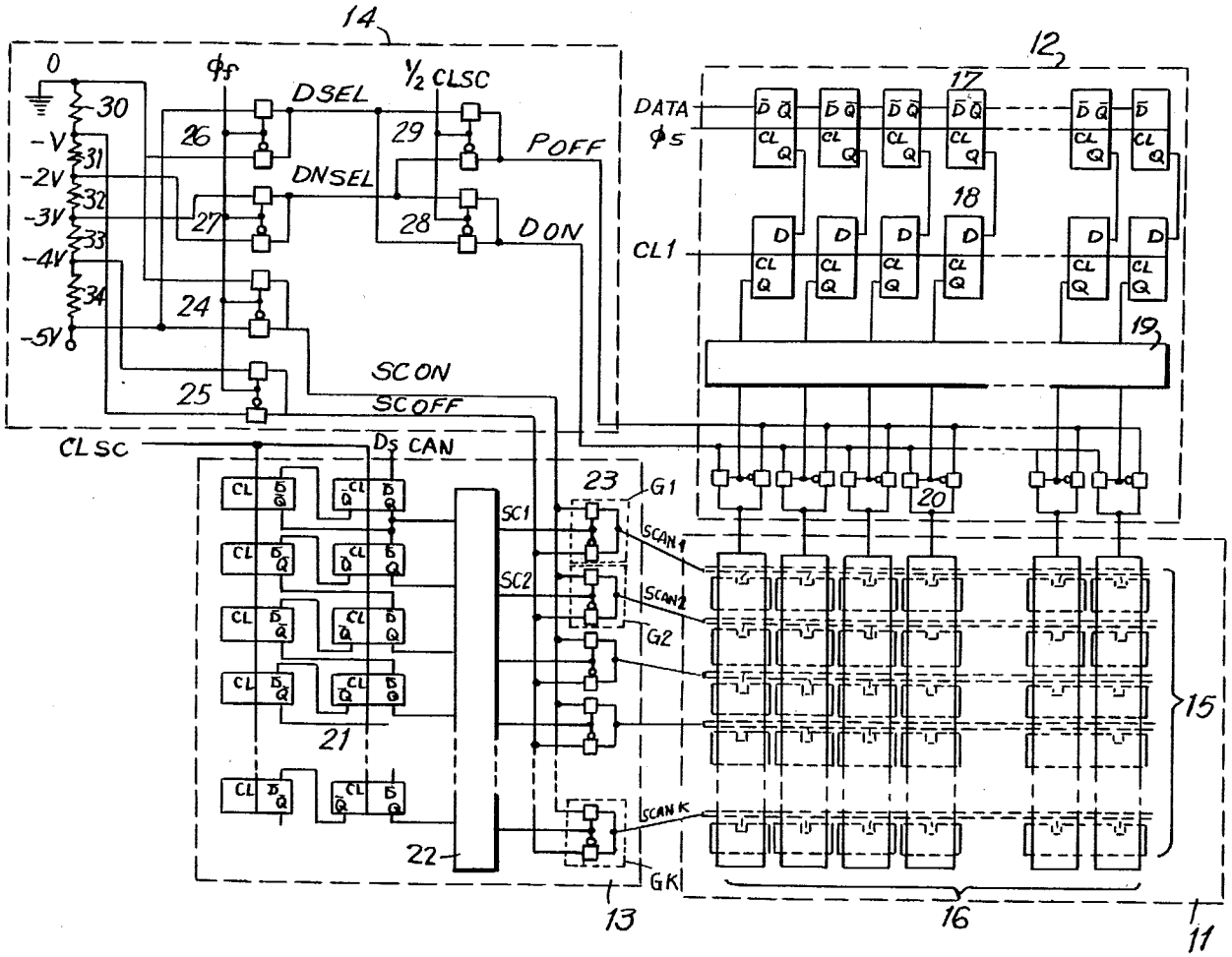
FIG. 10 is a circuit for driving a liquid crystal display matrix in accordance with the invention.

FIG. 10 illustrates a liquid crystal display device and a diagram of circuits for panel driving in accordance with the invention. This diagram includes a non-linear device dot matrix liquid crystal panel 11, display element driver portion 12, scanning element driver portion 13, and a driving signal generating portion 14. The liquid crystal panel 11 is comprised of scanning electrodes 15 and display electrodes 16. The display electrode driver portion 12 comprises shift registers 17 of J steps where J denotes the number of display signal electrodes, J latch circuits 18, which is a latch circuit composed of J flip-flops, which are coupled to each outlet of the shift registor, and a level shifter 19 which converts the logic level of the circuitry to the liquid crystal display level. The display electrode driver portion 12 also comprises J demultiplexers 20 which switch the display signal from the lit or non-lit level by a signal from the level shifter 19.

When the number of scanning electrodes is K, the scanning electrode driving portion 13 includes shift registers 21 having 2K flip-flops N, level shifter 22 and K demultiplexers 23 which switch to the selective or non-selective scanning signal by a signal from the level shifter 22. The driving pulse generating portion includes demultiplexers 24—29 and driving voltage generating resistors 30–34.

Figures 12A, 12B:
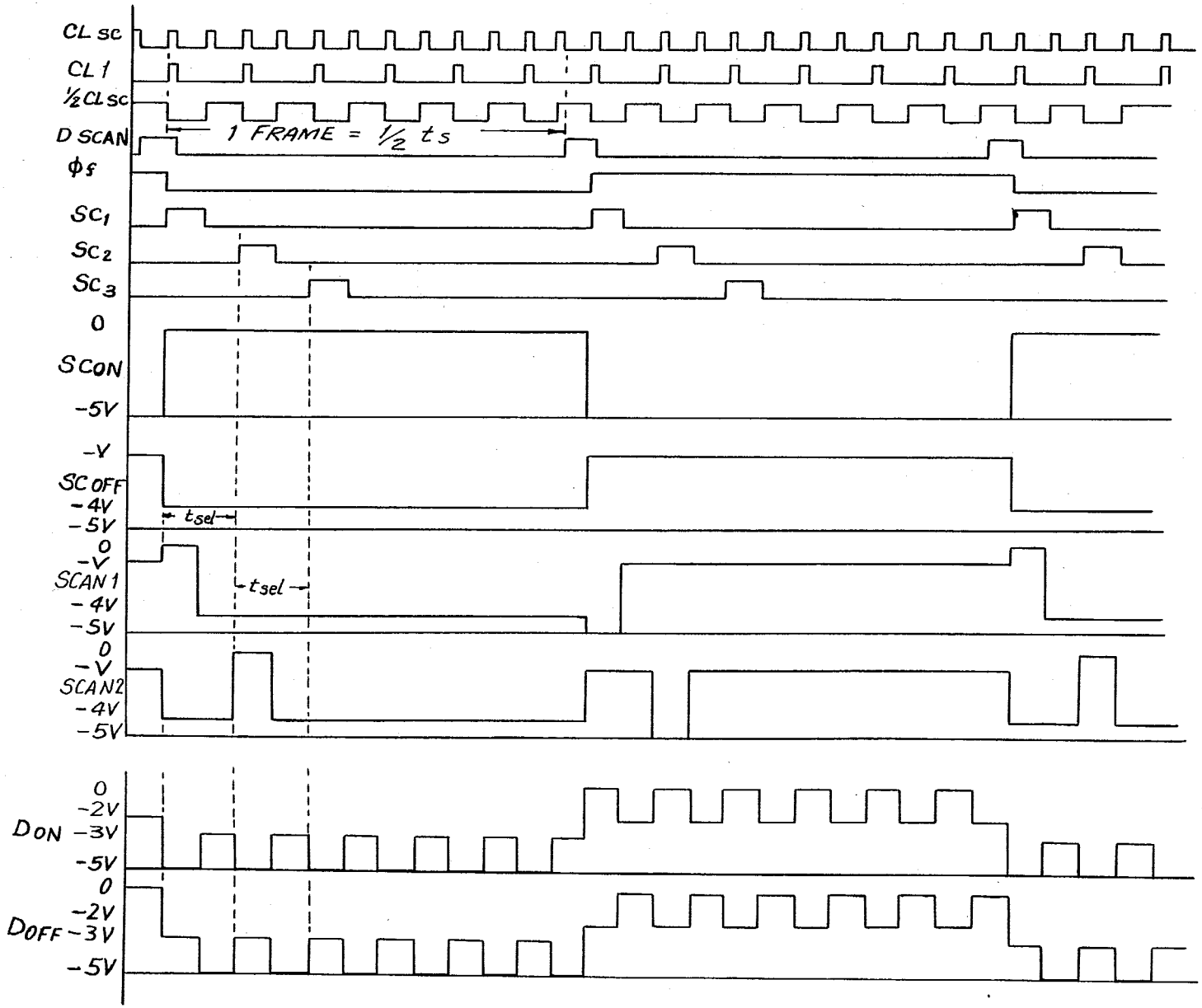

The embodiment of FIG. 10 is explained hereinafter in detail with reference to the timing charts of FIGS. 11 and 12*a,b*. In FIG. 11, $\phi$s is a transmitting clock pulse of a shift register 17, display data D dis (DATA) is transmitted from left to right in the register 17 from the pulses $\phi$s. When the quantity J of data for one line is transmitted, a clock pulse CL1 of latch circuit 18 turns high and data from the shift register 17 is latched into the latch circuit 18. The level of the data at the latch circuit 18 is shifted by the level shifter 19 and inputted to the control terminal of the multiplexers 20. The multiplexers 20 switch display signals DON or DOFF, delivered from the driving signal generating portion 14, depending upon the display data DATA signal stored in the latches 18.

D SCAN data, which goes high once in each half frame period, is delivered to the shift register 21 of the scanning electrode driver 13 by the scanning clock signal CLSC. The scanning clock signal CLSC has a logical total of pulses, which generate at the time when it is completed, to transmit the number of pulses, synchronized with the latch clock pulse CL1 and display data signal DATA, by J/2. Accordingly as shown in FIGS. 11, 13 CLSC is generated by RS flip-flop 32 and has a frequency double that of CL1. In this description J is the largest integral number not exceeding J/2 or the smallest integral number exceeding J/2 when J is an uneven number. The output of the uneven number steps among 2K flip-flops of the shift register 21 are connected to the level shifter 22. Accordingly, the output of each step of uneven numbers, such as SC1, SC2 and SC3, are indicated as shown in FIG. 12*a*. These outputs are supplied to the demultiplexers 23 through the level shifter 22. The demultiplexers 23 switch selective signal SC ON or non-selective signal SC OFF of the scanning signals by the signal SC1, SC2 . . . SCK. For the cited example the number of SC signals is 120.

Resistors 30—34 divide a voltage of −5 volts in voltage steps from −V to −5 V as indicated in FIG. 10. Demultiplexers 24,25 switch the levels of the scanning signal according to a frequency signal $\phi f$ for driving the liquid crystal with an alternating current, so that selective signal SC ON and non-selective signals SC OFF are produced. Demultiplexers 26,27 produce selective signals DSEL and non-selective signals DNSEL in the conventional driving method of display electrodes according to the frequency signal $\phi f$. Demultiplexers 28, 29 are vital to this invention as they switch selective signals DSEL or non-selective signals DNSEL by a clock signal ½ CLSC which is produced by dividing the clock signal CLSC by half. Thus, signals DON and DOFF of the display electrodes are produced as shown in FIG. 12*b*.

FIG. 13 is a diagram of a controlling circuit which generates clock pulses for the driving circuit in accordance with the invention, where, for an example, J=160 and K=120. The controlling circuit includes a six-bit binary counter 30, NOR gate 31, RS flip-flop 32, inverter 33, D-type flip-flops 34,35,39,41, NOR gates 36, 40, a six-bit binary counter, and an AND gate 38. The six-bit counter 30 counts clock pulses $\phi s$ supplied to the shift register 17 of the display electrode driver 12 (FIG. 10). When the count reaches J/2=80, it is detected by the gate 31 to set the RS flip-flop 32. The RS flip-flop 32 is synchronized to the rise of the signal $\phi s$ for resetting. The output from the RS flip-flop 32 is inputted to the reset terminal of the counter 30 and also as a clock input to the flip-flop 34. The D-type flip-flop 34 divides clock pulse CL SC in half to produce the signal ½ CL SC. This signal ½ CL SC is inputted to the D input of the D-type flip-flop 35. The signal ½ CL SC is differentiated by the D-type flip 35/NOR gate 36 combination to provide the signal CL1 having a period of one scanning period and supplied to the clock pulse input terminal of the latch 18.

After the counter 37 has counted 239 clock pulses CL SC from the RS flip-flop 32, the output from the AND gate 38 goes high. This high signal from the AND gate 38 is delayed by the D-type flip-flop 39 to be a delay signal D SCAN for the shift register 21 of the scanning electrode driver 13 (FIG. 10) and then this high signal is differentiated by a gate 40 to be a clock pulse for the D-type flip-flop 41. This clock pulse becomes the alternating driving signal $\phi f$ which alternately goes high and low per half period, that is one frame (½ ts), and is supplied to the demultiplexers 24–27 in the driving signal generating portion.

As described above, the driving method in accordance with the invention is accomplished by a relatively simple circuit construction. In accordance with this invention, the variation of the effective voltage due to the lit or non-lit state of the picture elements decreases. Therefore, the minimum of EON is high and the maximum of EOFF is low to improve the driving margin. The method of driving a liquid crystal display device in accordance with this invention applied to a liquid crystal display device of non-linear characteristics is effective in that a gray display can be made uniform over the entire display panel.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A driver circuit for a liquid crystal display having a liquid crystal panel with overlapping scanning and display electrodes forming a matrix of picture elements at the overlapping intersections of the scanning and display electrodes, the picture elements being defined by opposed portions of the scanning and display electrodes, each of the picture elements in the matrix being selected during a frame period during which each of the picture elements is caused to display an ON or OFF state as a result of a voltage difference between an opposed scanning electrode and an opposed display electrode, a scanning period being defined as the frame period divided by the number of scanning electrodes in the matrix, the driver circuit comprising:

nonlinear driving means associated with each of the scanning and display electrodes for driving the scanning and display electrodes in a nonlinear manner;

scanning electrode signal generating means for supplying a series of scanning signals to the respective nonlinear driving means for application to the scanning electrodes, each scanning signal for one of the scanning electrodes being at a selected level during a frame period for only a portion of one scanning period associated with one of the picture elements defined by the intersection of the one scanning electrode and the display electrodes, the scanning signal for the one scanning electrode being at a non-selected level during the remaining portion of said frame period;

display electrode signal generating means for supplying a display signal train for each of the display electrodes to the respective nonlinear driving means, each display signal train corresponding to one display signal electrode being composed of a series of display signal train segments, each display signal train segment being a scanning period long and corresponding to the scanning period of a picture element formed by the overlapping intersection of the one display electrode and one of the scanning electrodes, each display signal train segment having a first portion at a selected level and a second portion at a non-selected level, the first portion of the signal train segment substantially coinciding with the selected level portion of the scanning signal for the picture element when the picture element is to display an ON state and the second portion of the signal train segment substantially coinciding with the selected level portion of the scanning signal for the picture element when the picture element is to display an OFF state;

whereby the display of the picture element formed by a display electrode is substantially unaffected by the number of picture elements to display an ON state in a display signal train.

2. The driver circuit of claim 1 wherein the non-linear driving means is a series of metal-insulator-metal devices having non-linear characteristics.

3. The driver circuit of claim 1 wherein the non-linear driving means is a series of varistors and diodes connected in series in the reverse directions utilizing the avalanche breakdown voltage in junctions, having non-linear characteristics.

4. The driver circuit of claim 1 wherein the nonlinear driving means is a series of active switching elements.

5. The driver circuit of claim 1 wherein the portion of one scanning period at which the scanning electrodes signal is at the selected level is a fine scanning period.

6. The driver circuit of claim 5 wherein the fine scanning period is one-half of a scanning period.

7. The driver circuit of claim 6 wherein the first portion and the second portion of each of the display signal train segments are substantially equal in duration to the fine scanning period.

8. The driver circuit of claim 5 wherein the fine scanning period is less than one-half of the scanning period.

9. The driver circuit of claim 5 wherein each first portion of the display signal train segment is substantially equal to the fine scanning period.

10. The driver circuit of claim 5 wherein each scanning period is composed of at least two fine scanning periods.

11. The driver circuit of claim 1 wherein the display signal train includes a plurality of display signal train segments.

12. The driver circuit of claim 11 where the number of display signal train segments is equal to the number of scanning electrodes.

13. The driver circuit of claim 1 wherein the display signal train is equal in length to the frame period.

14. The driver circuit of claim 13 wherein the scanning electrode signal generating means and display electrode signal generating means further generate scanning signals and display signal train of inverted polarity during a second frame period.

15. The driver circuit of claim 1 wherein the duration of the first portion is equal to the duration of the second portion.

16. The driver circuit of claim 15 wherein the duration of the first portion and the duration of the second portion together equal the scanning period.

17. The driver circuit of claim 15 wherein each display signal train segment further includes a pause portion.

18. The driver circuit of claim 1 wherein the duration of the first portion and the duration of the second portion together equal the scanning period.

19. The driver circuit of claim 1 wherein each display signal train segment further includes a pause period.

20. The driver circuit of claim 1 wherein the selected levels of the scanning signals and the display signal trains are variable so that a gray scale is displayed.

* * * * *